US007886916B2

(12) United States Patent
Alyn

(10) Patent No.: US 7,886,916 B2
(45) Date of Patent: Feb. 15, 2011

(54) EXPANDABLE MODULAR DISPLAY STAND

(76) Inventor: Scott Hammer Alyn, 313 Leeward Ct., Fort Collins, CO (US) 80525

( * ) Notice: Subject to any disclaimer, the term of this patent is extended or adjusted under 35 U.S.C. 154(b) by 330 days.

(21) Appl. No.: 11/959,240

(22) Filed: Dec. 18, 2007

(65) Prior Publication Data

US 2009/0151211 A1 Jun. 18, 2009

(51) Int. Cl.
*A47F 7/14* (2006.01)

(52) U.S. Cl. ..... 211/55; 211/57.1; 211/189

(58) Field of Classification Search ..... 211/52, 211/55, 128.1, 130.1, 186, 189, 190, 184, 211/57.1
See application file for complete search history.

(56) References Cited

U.S. PATENT DOCUMENTS 322,758 A * 7/1885 Smead ..... 211/50
457,598 A * 8/1891 Briggs ..... 206/45.23
855,862 A * 6/1907 Morse ..... 211/55
918,186 A * 4/1909 Morse ..... 211/55
1,594,754 A * 8/1926 Reines ..... 108/61
1,746,778 A * 2/1930 Kilgore ..... 211/52
3,255,987 A * 6/1966 Gatch ..... 248/220.31
3,777,897 A * 12/1973 Gray ..... 211/55
4,765,492 A * 8/1988 Howard et al. ..... 211/55
5,085,328 A * 2/1992 Evenson ..... 211/55
6,890,138 B1 * 5/2005 Myrick ..... 410/94

* cited by examiner

*Primary Examiner*—Korie Chan
(74) *Attorney, Agent, or Firm*—Benjamin Hudson, Jr.

(57) ABSTRACT

There is provided an expandable modular display that is generally comprised of display modules that may be wall mounted, utilized as a desktop or countertop display, or vertically stacked with a plurality of like display modules in a display stand. The display stand is disposed to be connected by hand utilizing connecting apertures and pins. The display stand may be expanded horizontally using the connecting apertures and pins to receive additional display modules. The display is disposed to mount display modules vertically in a back to back position.

5 Claims, 9 Drawing Sheets

EXPANDABLE MODULAR DISPLAY STAND

BACKGROUND OF THE INVENTION

1. Field of the Invention

This invention relates generally to display stands for displaying merchandise of all types such as stationer), products, books, brochures, jewelry, etc. and more particularly to display stands that stand upright and are disposed to receive both vertical and horizontal modular expansion shelves or sections to increase display space.

2. Brief Description of the Prior Art

It is generally known to provide display structures in retail stores for displaying merchandise such as books, brochures, etc. which is generally comprised of a plurality of shelves arranged in a structure for supporting the shelves at different elevations. Many of these display constructions are comprised of book shelf type constructions wherein horizontal shelves are connected to side walls with a back section for support. These shelving components may be configured in a variety of ways to be position in different vertical elevations between the side wails and back sections.

Generally a distributor of products will present a point of sale display of a product with a functional stand or rack which is designed to hold and contain the product that is to be sold and located in a manner that is easy for a potential purchaser to view and examine. Many of these point of purchase displays are designed and manufactured so that installation at a retailer can be accomplished with a minor amount of assembly, such as locating the display on a fold-up base, locate the display at a particular desired location on the floor of a store. Such displays that are in common usage are normally constructed of a lightweight inexpensive material such as cardboard.

Since many erectable stands and displays are made of cardboard they require special design to prevent the display and merchandise from tipping over and also must be placed in areas away from traffic. Cardboard material has traditionally been the material of choice for merchandising displays because of the ease of which this material can be used to make collapsible merchandise displays. However, erection of such displays can sometimes be difficult because of the flimsiness of the material and thus the support of the merchandise to be displayed may sometimes be compromised. It would be desirable if there were provided a sturdy upright merchandise display that was constructed for ease of erection and was also collapsible. It would be further desirable if such a display was expandable to extend the merchandise display area. It would be further desirable if the merchandise display design was modular in construction with modular sections that are disposed to be stand alone displays for counter, desktop, shelf, or wall display of merchandise.

SUMMARY OF THE INVENTION

There is provided by this invention a product display design that is modular in construction wherein the user may have three display units in one. The modular construction allows the user to sit a single display module on a counter, shelf or stand, hang a single module on a wall, or stack a multitude of modules vertically into a floor stand. When multiple modules are erected into a floor stand, an expansion means is provided that allows the floor stand to be expanded horizontally for additional vertical stacks of modules as well mounting modules back to back on the floor stand. Each display module is comprised of movable pegs for unlimited product positioning.

BRIEF DESCRIPTION OF THE PREFERRED EMBODIMENT

Figure 1:
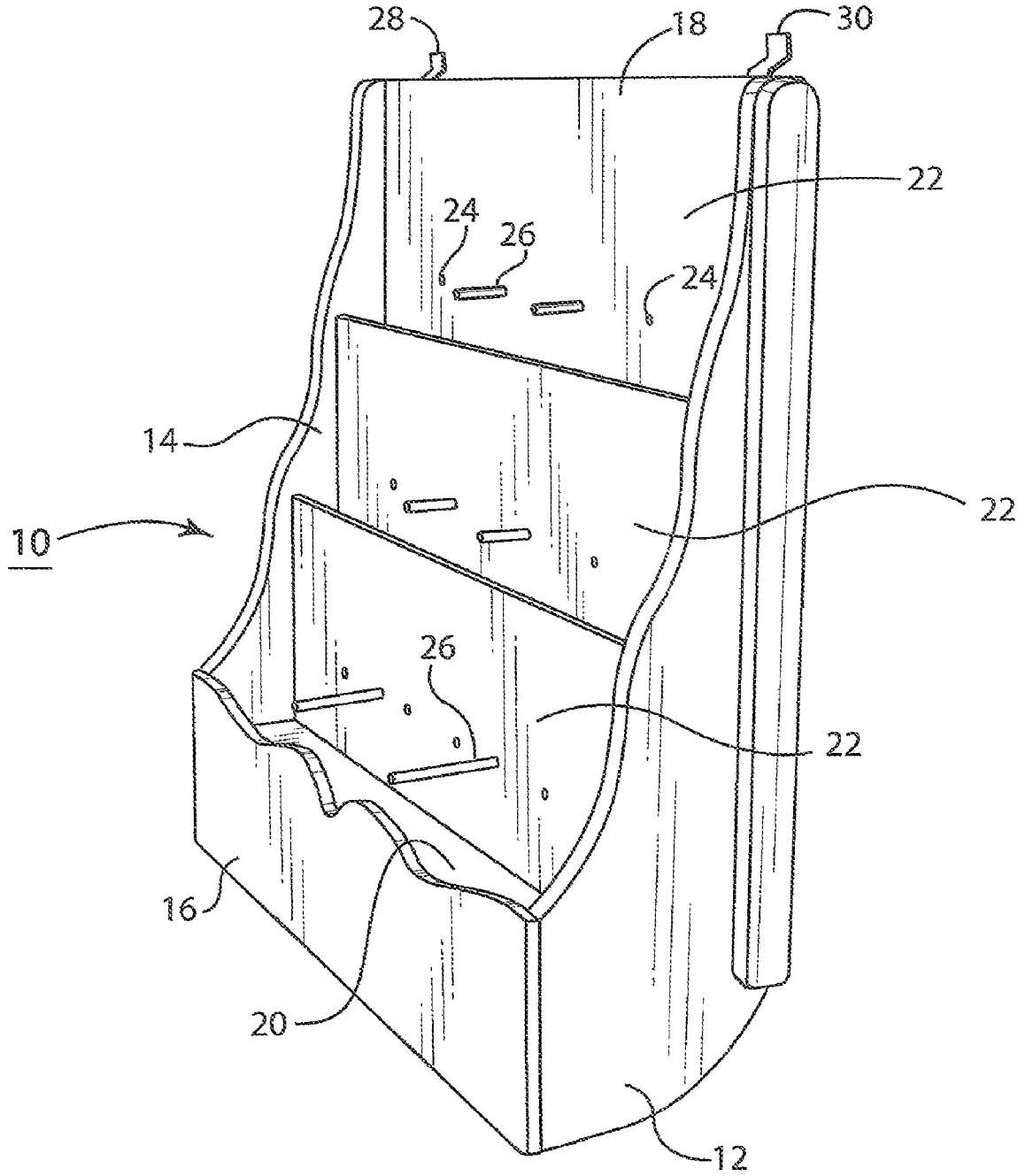
FIG. 1 is a perspective view of a display module incorporating the principles of this invention.

Referring to FIG. 1 there is shown a display module 10 that incorporates the principles of this invention. The display module is generally comprised side boards 12, 14, a lower front bottom board 16 and a back board 18. Shelf dividers such as 20 are connected to the side boards 12 and 14 by slots in the side boards for support or by other attachment means not shown but well know to those skilled in the art. The shelf dividers are connected to and support integrated easel stands 22 which are generally comprised of multiple apertures 24 for movable pegs 26 to provide unlimited product positioning. The shelf design may be utilized to hold notepads, journals, mini-books, brochures, etc. The side boards 12, 14, and shelf dividers 20 may be comprised of ½ Baltic birch woods, although other suitable materials may be used. Slat hangers 28 and 30 are connected to the module 10 for positioning and hanging the unit on a slat wall, column, etc. The module may also be hung by conventional picture hangers.

Figure 2:
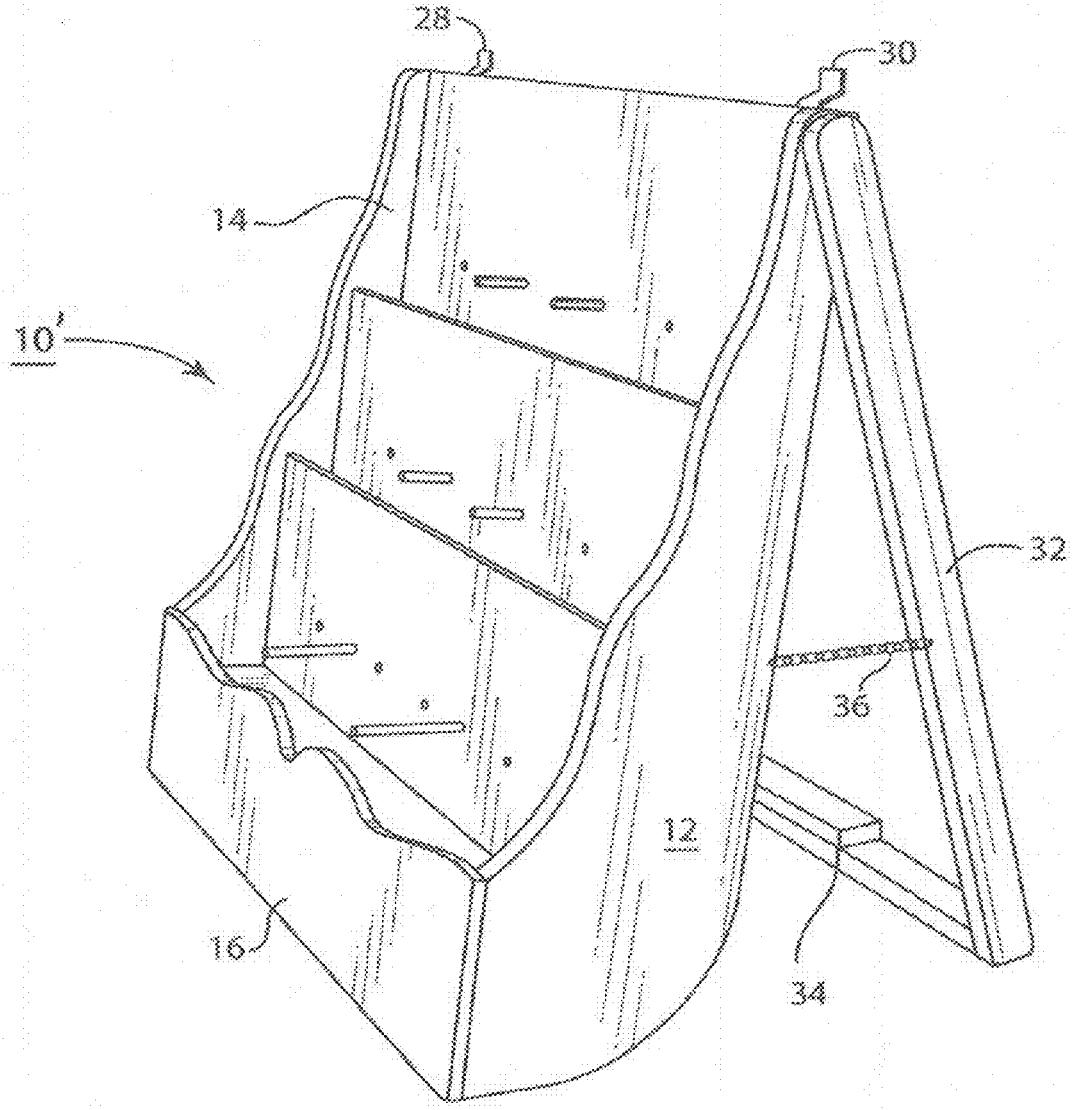
FIG. 2 is another perspective view of a display module incorporating the principles of this invention.

Referring to FIG. 2, there is shown the display module 10' with an extension arm 32 in conjunction with a lower support bracket 34. The module 10' has extension arms 32 on each side of the module connected thereto which extend to allow the module to function as a shelf or counter display rack. The adjustable arms are also used to push the angle of the module away from a slat wall or display stand. An adjustable chain such as 36 is provided to control the extension of the arms 32. The adjustable arms 32 allow the user to control the upright display of the module for either a shelf or counter top merchandise display.

Figure 3:
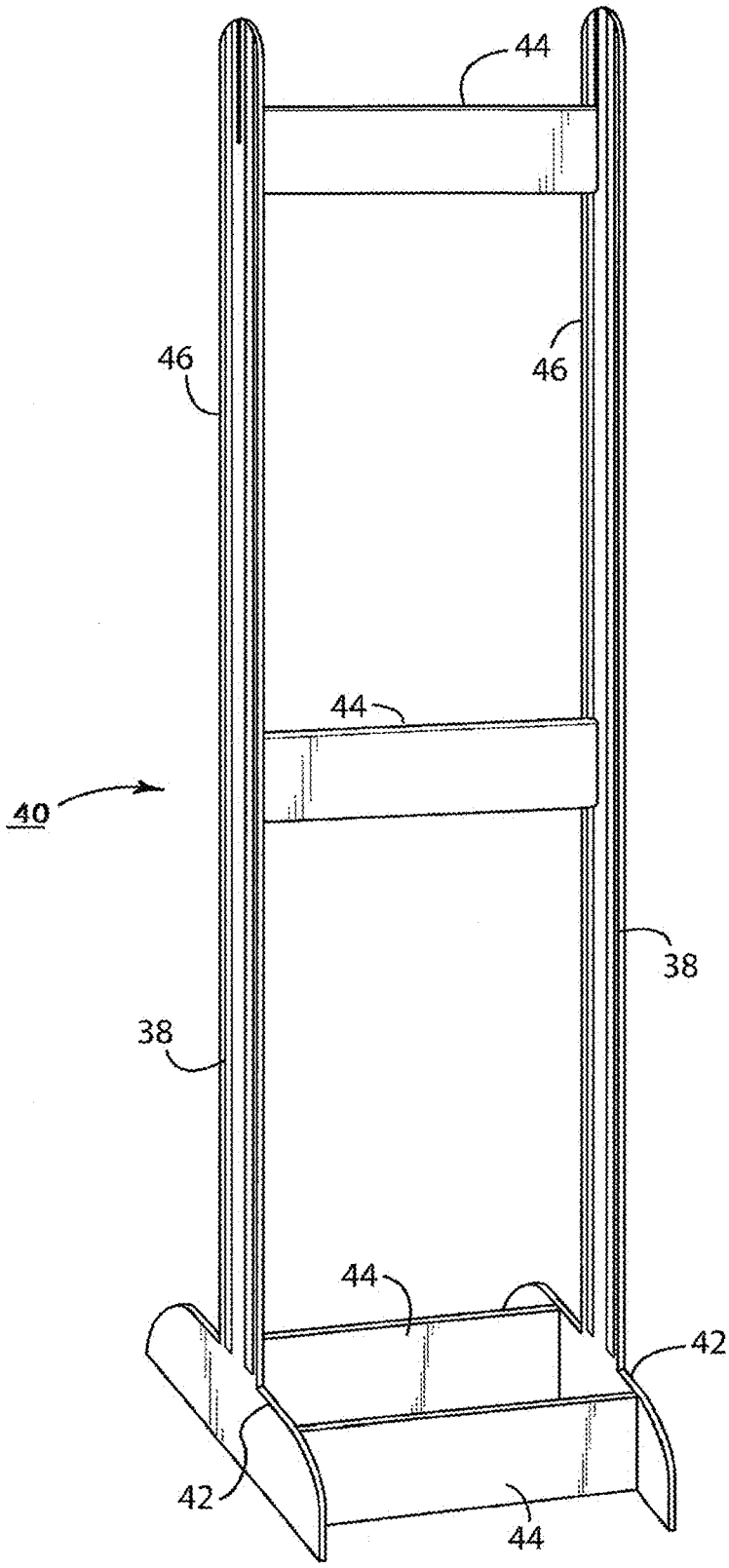
FIG. 3 is a perspective view of floor stand for stacking display modules in a vertical position.

FIG. 3 is a perspective view of floor stand 40 for stacking display modules such as 10 in a vertical position in a manner hereinafter described. The floor stand is generally comprised of two vertical rails 38 having foot sections such as 42 disposed to support the rails in an upright position. Horizontal crossbars such as 44 are connected to the rails 38 by connecting apertures and pins that allow the members to be connected by hand, not shown but well known to those skilled in the art for connecting furniture and the like. The horizontal cross members support the rails and hold them upright to stand in a vertical position. The rails 38 are comprised of slots 46 on the interior and exterior portions of the rails to receive the extension arms 32 of the display modules so that the display modules can be stacked vertically within the floor stand 40 in a manner hereinafter described.

Figure 4:
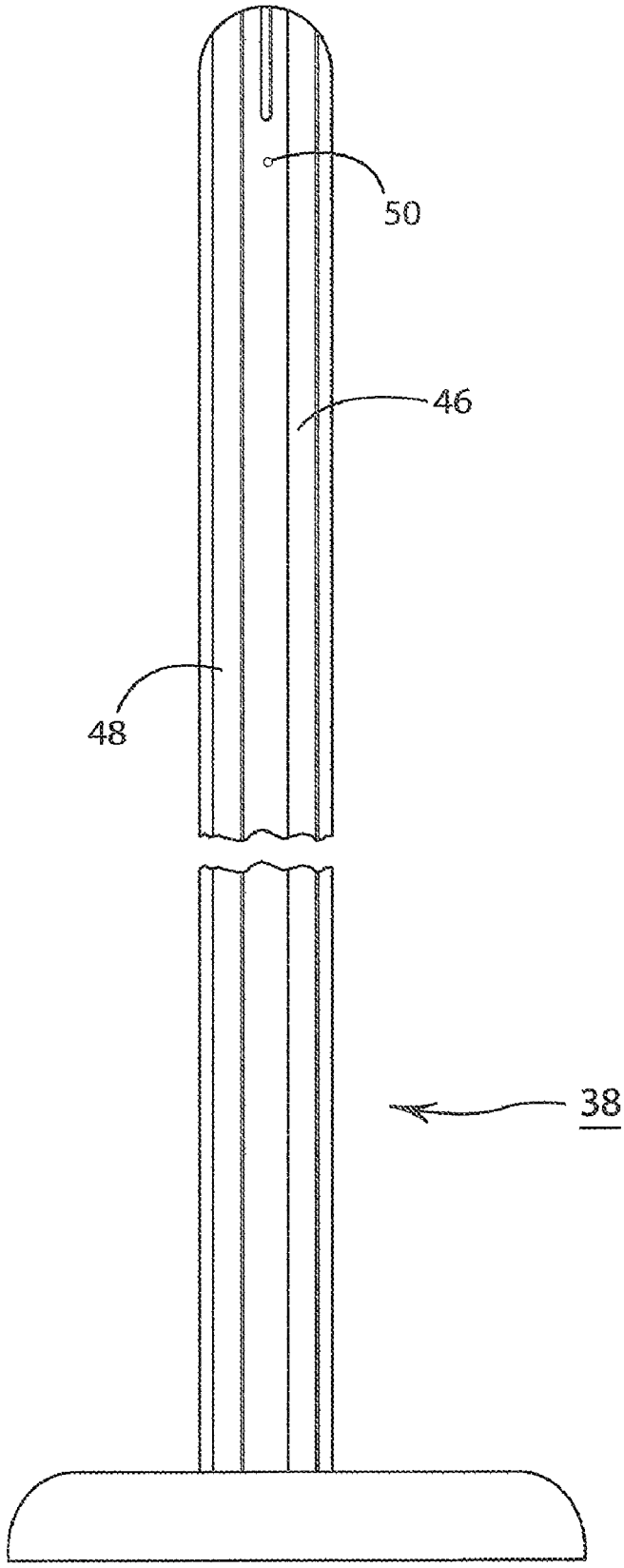
FIG. 4 is an end view of a vertical member of the floor stand shown in FIG. 3.

Referring to FIG. 4 there is shown an end view of a vertical member 38 of the floor stand 40 shown in FIG. 3. Each rail 38 is comprised of a slot 46 made in the rail that is disposed to receive the extension arms 32 of the display module 10. A second slot 48 in the rail 38 opposite the slot 46 is also disposed to receive extension anus 32 so that display modules may be placed back to back inside the support stand. Pins such as 50 are positioned in the rails to connect to and support the horizontal crossbars 44. Each of the crossbars is comprised of a connecting aperture-type member to mate with the support pins in a manner well known to those skilled in the art.

Figure 5:
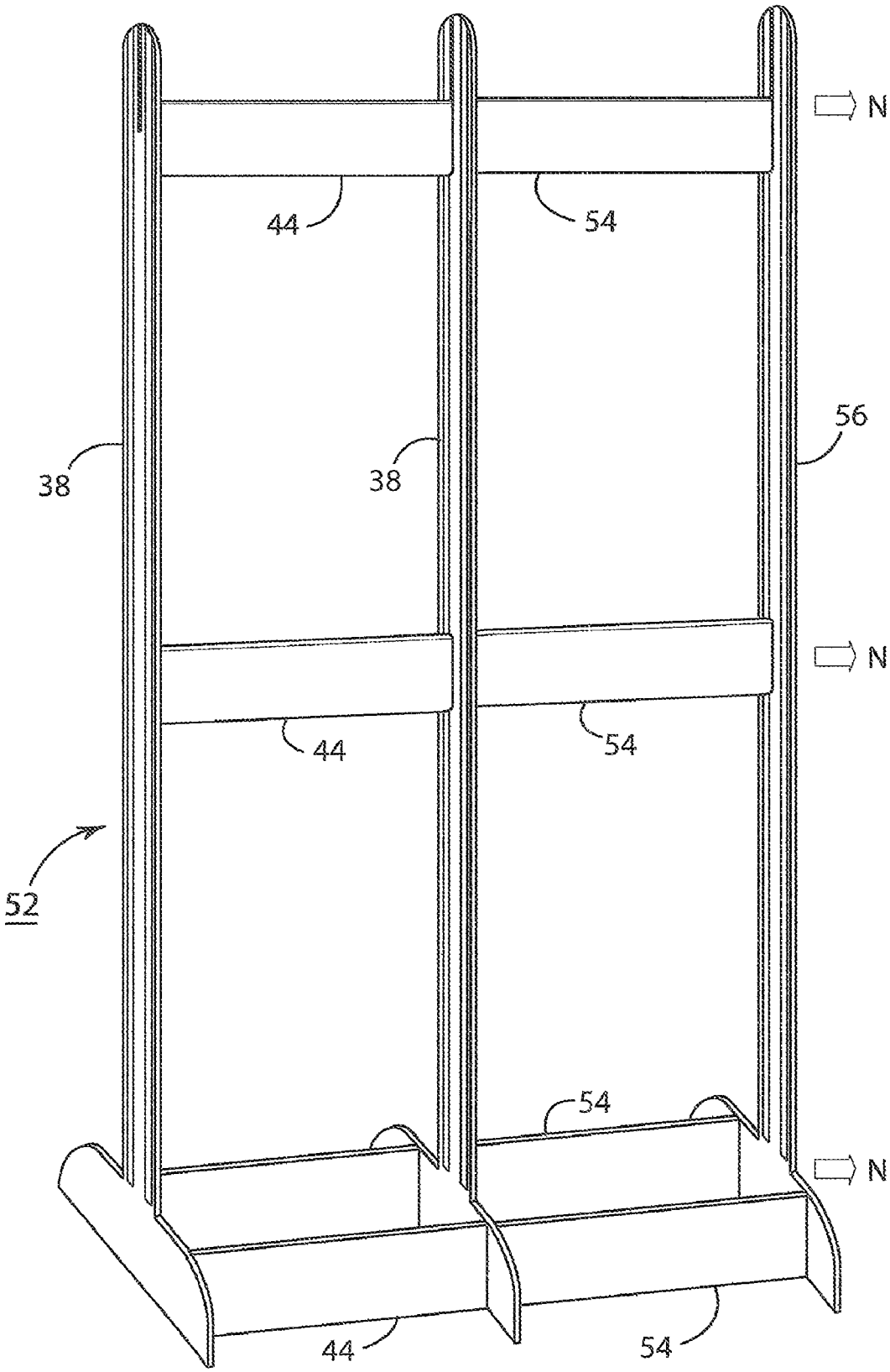
FIG. 5 is a perspective view of a floor stand expanded horizontally.

Referring to FIG. 5 there is shown an expanded support stand 52 wherein additional crossbar members 54 are connected to the rail 38 and expansion rail 56 to expand the support stand horizontally so that the stand 52 may accommodate additional display modules in a manner hereinafter described. As shown the support stand may be expanded to N number of units to support a multitude of display modules.

Figure 6:
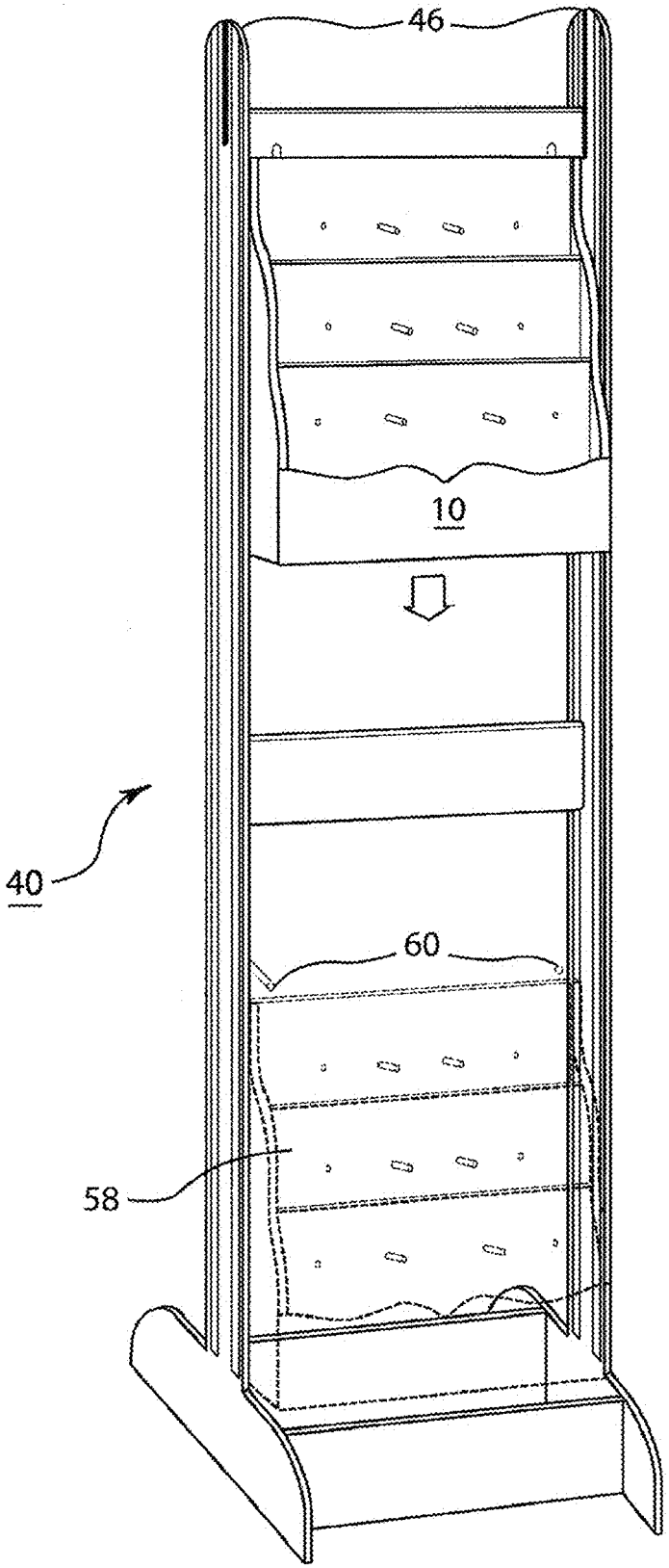
FIG. 6 is a perspective view of a display module positioned in a floor stand.

Referring to FIG. 6 there is shown a support stand 40 having mounted therein a display module 10 placed between the slots 46. The display module slides down the slots 46 until it reaches the position 58 as shown. Once the first display module is in position the stand is then ready to receive a second display module in a similar manner. Support pins such as 60 are placed in position above the first display module installed to stop and support a second display module when it is placed in the rails. This is repeated for each display module installed in the stand.

Figure 7:
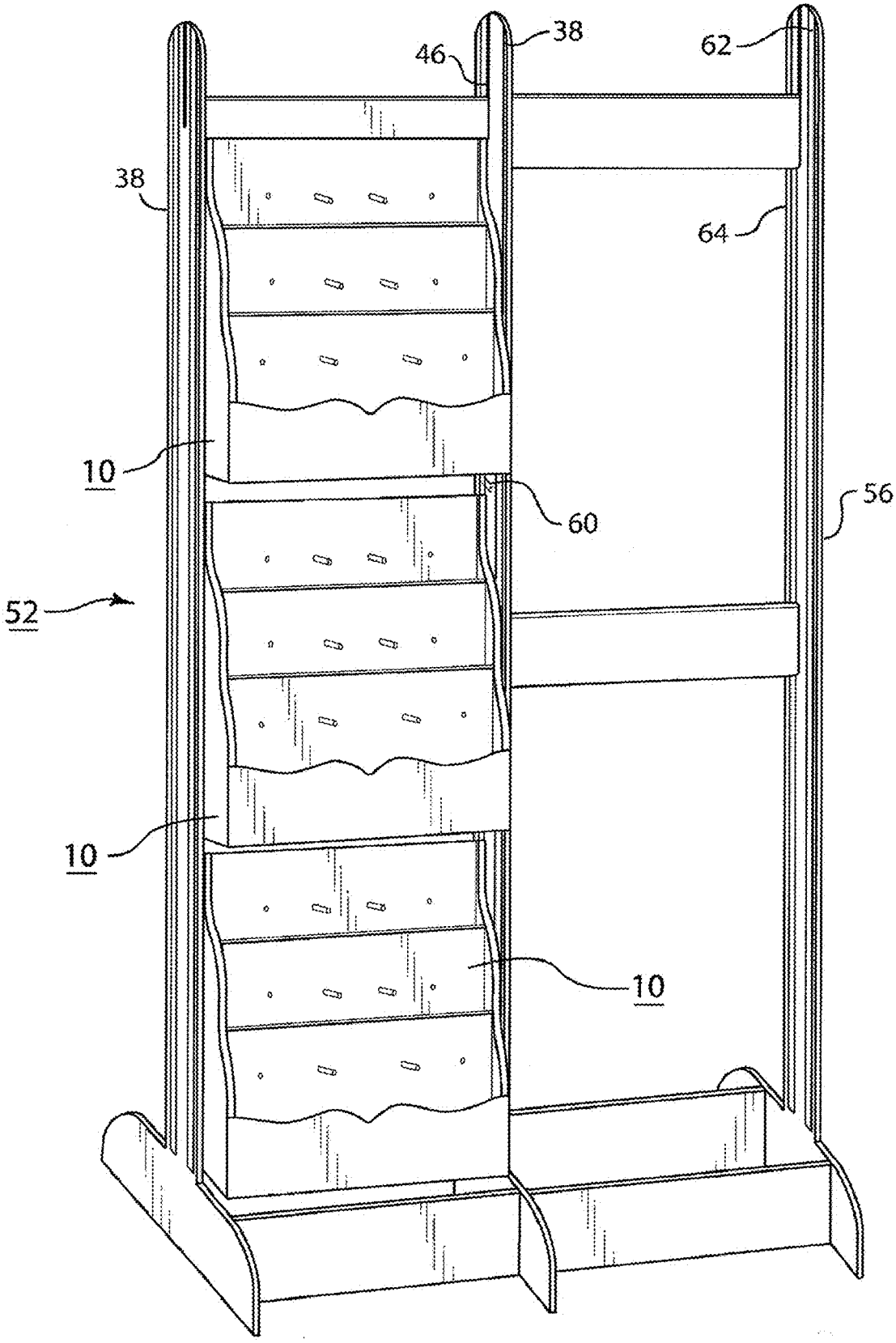
FIG. 7 is a perspective view of display modules vertically stacked in a floor stand.
Figure 8:
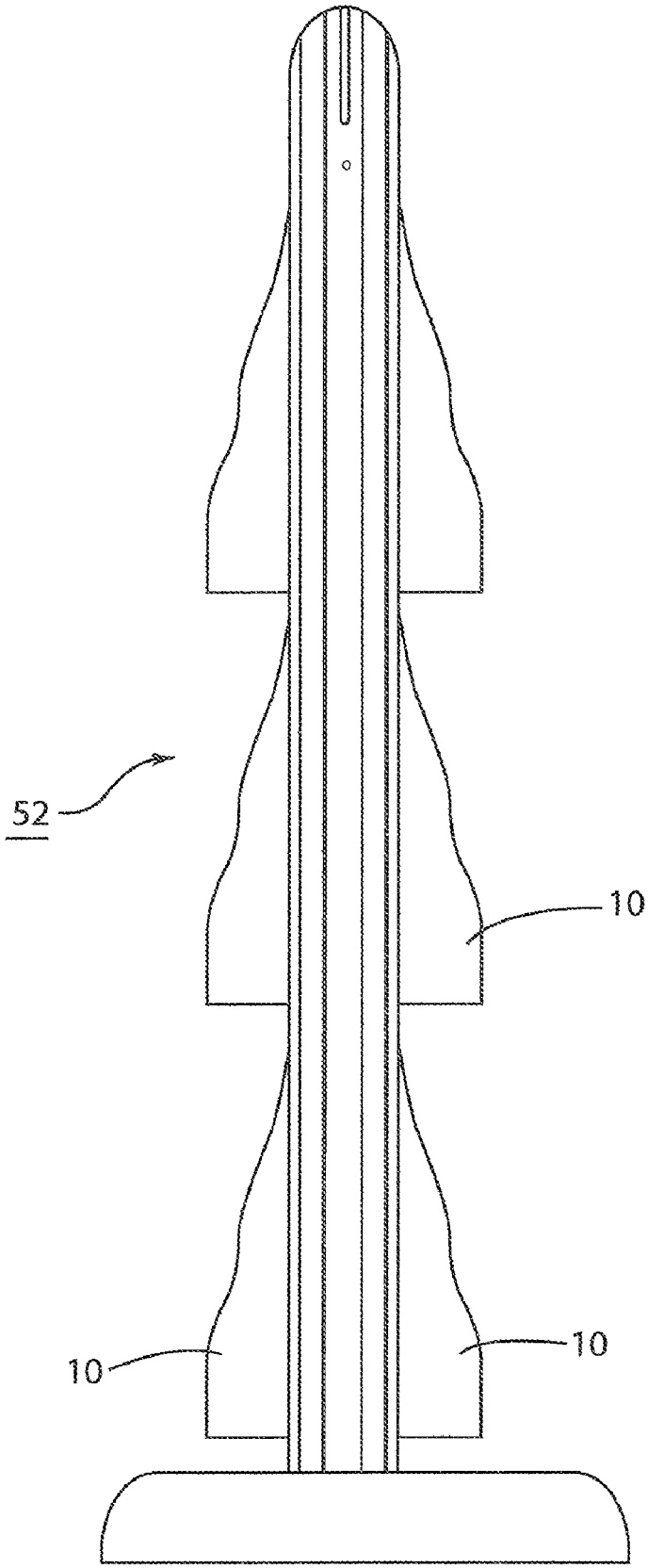
FIG. 8 is a perspective view of a floor stand illustrating vertically stacked display modules on the floor stand in a back to back position.

FIG. 7 is a perspective view of display modules 10 vertically stacked in an expanded floor stand 52. Each of the display modules are positioned inside the slots 46 of the rails 38 until it reaches a support stop and pin such as 60. Additional modules may be placed within the expansion rail 56 utilizing the slots 62. The floor stand 52 as shown may accommodate six display modules 10 on the front side alone. An additional six may be placed on the opposite side of the modules shown in a back to back position utilizing slots such as 64 shown on the opposite side of the rail 56. This back to back mounting of the modules 10 on the floor stand 52 is shown in FIG. 8.

Figure 9:
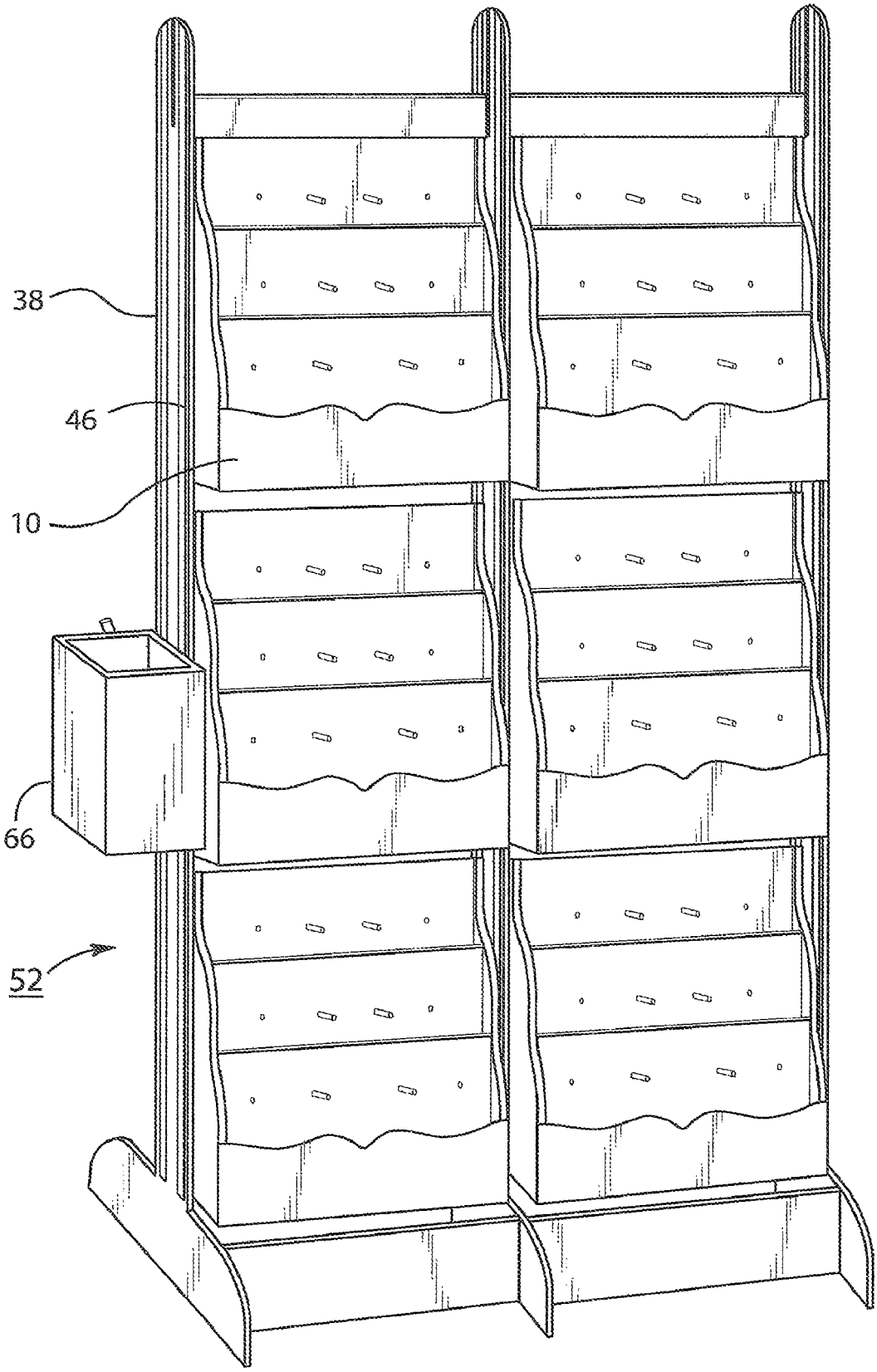
FIG. 9 is a perspective view of a floor stand expanded horizontally having vertically stacked display modules.

FIG. 9 illustrates a perspective view of a floor stand expanded horizontally having vertically stacked display modules 10 mounted thereon. In addition to supporting the display modules 10, the slots 46 on the rails 38 may also support supplemental boxes such as 66. The boxes 66 may be used to display rolled posters and other merchandise items.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

I claim:

1. An expandable modular display, comprising a display module comprising:

at least two side walls disposed to attach to and support a plurality of display shelves vertically connected to the side walls and spaced from the top to the bottom of the side walls;

easel stands connected to the back of the display shelves forming display bins, the easel stands having multiple apertures therein disposed to receive positioning pegs for providing positioning of product width to be displayed on the display shelves;

a back wall connected to the side walls having connected thereto slat wall hangers for hanging the modular display on a slat wall or column;

extension arms pivotally connected to points on each of the side walls disposed to support the modular display in an upright position on a horizontal surface;

a vertical stand for stacking a plurality of said display modules in an upright vertical position; the vertical stand further comprising at least two vertical rails supported by horizontal cross members to maintain the vertical rails in an upright position;

each of the vertical rails is comprised of mounting means for receiving the display module wherein a plurality of display modules may be mounted in a vertical position on the vertical stand; and said mounting means for receiving the display modules are slot-like grooves in the vertical rails are disposed to receive the extension arms of the display module wherein a plurality of display module slides within the grooves to a position on the vertical stand.

2. A modular display as recited in claim 1 wherein the vertical rails and horizontal cross members are comprised of connecting apertures and pins disposed to connect the members together by hand for case of assembly.

3. A modular display as recited in claim 1 wherein the vertical rails are comprised of connecting apertures and pins disposed to receive additional horizontal cross members and additional vertical rails to expand the display stand horizontally to accommodate additional display modules.

4. A modular display as recited in claim 1 wherein the vertical rails are comprised of said slot-like grooves to receive additional boxes on the display stand for displaying items like rolled posters.

5. A modular display as recited in claim 1 wherein the display modules are disposed to be mounted vertically in a back to back position between the rails.

* * * * *